United States Patent [19]

Yamasaki et al.

[11] Patent Number: 4,696,466

[45] Date of Patent: Sep. 29, 1987

[54] SORTER FOR ELECTROPHOTOGRAPHIC COPYING MACHINE

[75] Inventors: Kimihito Yamasaki, Ikoma; Shoichiro Yoshiura, Yamatokoriyama, both of Japan

[73] Assignee: Sharp Kabushiki Kaisha, Osaka, Japan

[21] Appl. No.: 804,474

[22] Filed: Dec. 4, 1985

[30] Foreign Application Priority Data

Dec. 5, 1984 [JP] Japan ..... 59-258632

[51] Int. Cl.[4] ..... B65H 39/10

[52] U.S. Cl. ..... 271/288; 271/297; 271/298

[58] Field of Search ..... 271/288, 289, 290, 297, 271/298

[56] References Cited

U.S. PATENT DOCUMENTS 3,709,485 1/1973 Acquaviva ..... 271/290 X
3,845,949 11/1974 Acquaviva ..... 271/290
4,285,591 8/1981 Botte ..... 271/290
4,318,542 3/1982 Altmann ..... 271/290
4,344,614 8/1982 Kaneko ..... 271/288

FOREIGN PATENT DOCUMENTS 30373 6/1981 European Pat. Off. .

*Primary Examiner*—Richard A. Schacher
*Attorney, Agent, or Firm*—Birch, Stewart, Kolasch & Birch

[57] ABSTRACT

An electrophotographic copying machine is equipped with a sorter. The copying machine comprises a sort switch, an interruption sort switch, a bin serial number memory for storing the serial number of the last operated bin in the sort mode, a detection device, and an interruption-sort device. The detection device is operated to detect whether the interruption switch is operated each time the sorting of copied papers by the sorter is completed. If the detection device detects that the interruption switch is actuated, the interruption-sort device sorts the subsequent copied papers into the subsequent bins with their serial numbers following the serial number of the last bin stored in the bin number memory.

4 Claims, 3 Drawing Figures

SORTER FOR ELECTROPHOTOGRAPHIC COPYING MACHINE

BACKGROUND OF THE INVENTION

The present invention relates to an electrophotographic copying machine and, more particularly, to a sorter for an electrophotographic copying machine.

An electrophotographic copying machine produces an electrostatic latent image onto a photorecepter corresponding to a pattern image on a document such as a book to be copied. Toner particles are electrostatically adhered to the latent image, so that the latent image becomes visible as a toner image. The toner image on the photorecepter is transferred onto a copy paper via a transference charger. A sorter may be coupled to the copying machine for sorting a plurality of copied papers into each one of a plurality of bins therein in the order of a plurality of documents copied.

Conventionally, while the copying machine is placed in a sorting mode with the sorter, if some papers are to be copied in the middle of the sorting mode, an interruption mode must be selected by releasing the sorting mode. After the copying of such papers, the sorting mode should be reselected. It is somewhat troublesome to repeatedly interrupt the sorting mode. Moreover, when the operator wishes to copy two different sets of documents, each to be copied in the sorting mode, so as to prepare separate sets of copied papers, he must remove the first set of sorted papers from the sorter prior to sorting the second set of copied papers.

SUMMARY OF THE INVENTION

Accordingly, it is an object of the present invention to provide an improved sorter for an electrophotographic copying machine for subsequently sorting two or more different sets of copied papers.

It is another object of the present invention to provide an improved sorter for an electrophotographic copying machine for simplifying the selection of an interruption mode while the copying machine is in a sorting mode.

Briefly described, in accordance with the present invention, an electrophotographic copying machine with a sorter comprises interruption switch means, bin number memory means for sorting the serial number of the last operated bin in the sorter, detection means, and interruption-sorting means. The detection means is operated to detect whether the interruption switch means is operated each time the sorting of copied papers by the sorter is completed. If the detection means detects that the interruption switch means is actuated, the interruption-sorting means sorts the subsequent copied papers into the subsequent bins with their serial numbers following the serial number of the last bin stored in the bin number memory means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
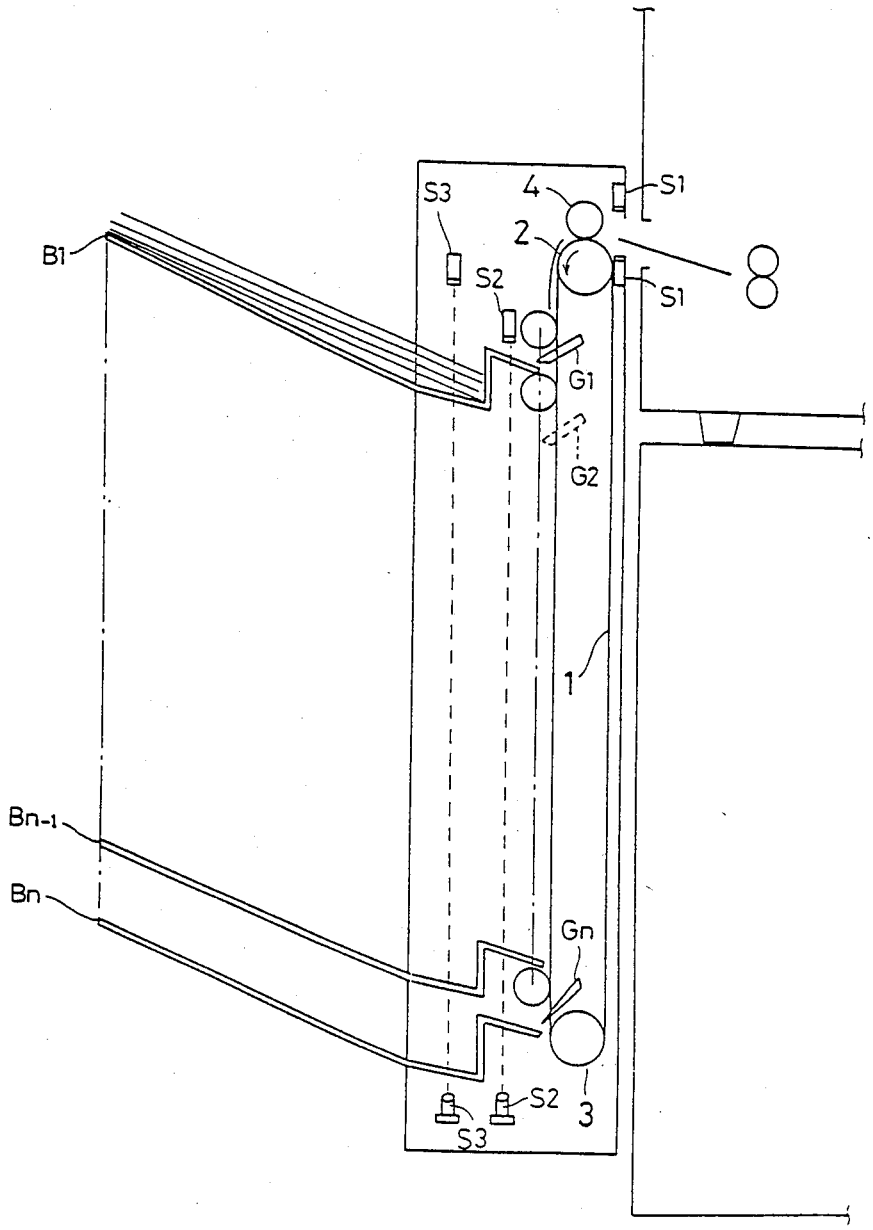
FIG. 1 is a vertical sectional view of a sorter for an electrophotographic copying machine according to the present invention.

FIG. 1 shows a vertical sectional view of a sorter for an electrophotographic copying machine according to the present invention.

Referring to FIG. 1, the sorter of the copying machine comprises a transport belt 1 extended between rollers 2 and 3 disposed at the upper and lower portions. This belt 1 is used to transport copied papers. An exhaustion outlet from the copying machine is positioned between the upper roller 2 and a guide roller 4 opposing each other. The copied papers are exhausted from the outlet and transported into the inner portion of the sorter by the counterclockwise rotation of belt 1. A plurality of guides G1 to Gn are aligned in the direction of transporting the copied papers from the exhaustion outlet for guiding the copied papers into bins B1 to Bn.

The copying machine for the present invention comprises a central processing unit (CPU) control means, and memory means. The control means is provided for generating signals uprighting each of the guides G1 to Gn against the transporting way of the papers, so that each of the papers is placed into each of the bins B1 to Bn. Three photosensors S1 to S3 are provided for detecting the presence of one copied paper at each of the respective positions. The photosensor S1 is positioned between the belt 1 and the exhaustion outlet from the copying machine. The photosensor S2 is positioned adjacent the paper insertion side toward the bins B1 to Bn. The photosensor S3 is positioned so as to detect the presence of the paper inside the bins. Each of these photosensors comprises a light emitting device and a light receiving device.

Figure 2:
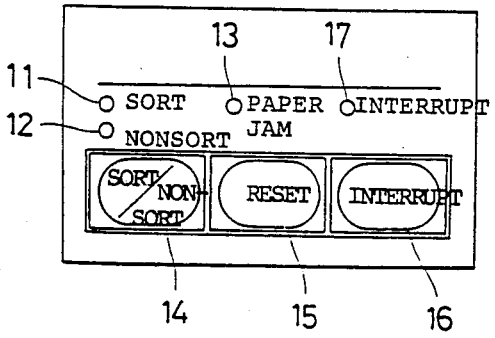
FIG. 2 shows a plan view of operation switches on a panel in the copying machine of FIG. 1.

FIG. 2 shows a plan view of operation switches disposed on an operation panel of the copying machine of FIG. 1.

Referring to FIG. 2, a sort switch 14 is operated to select the sorting of the copied papers in the sort mode, or to simply overlap on an exhaust tray without being sorted. A reset switch 15 is operated to restart the sort mode if the sort mode has been stopped for some reason or the a paper jam has been removed. An interruption switch 16 is operated to interrupt the sort mode in order to copy and sort some additional documents, the additional documents being different from the documents originally intended to be sorted. The switch 16 is otherwise operated to continue to sort two different sets of copied papers one after another, namely, in the manner that first and second sets of copied papers should be subsequently sorted. A sort mode display 11 and a non-sort mode display 12 are provided to display the sorting or non-sorting conditions, respectively. A jam display 13 is illuminated to indicate that there is a paper jam within the copying machine. An interruption display 17 is illuminated to indicate selection of the interruption mode.

Figure 3:
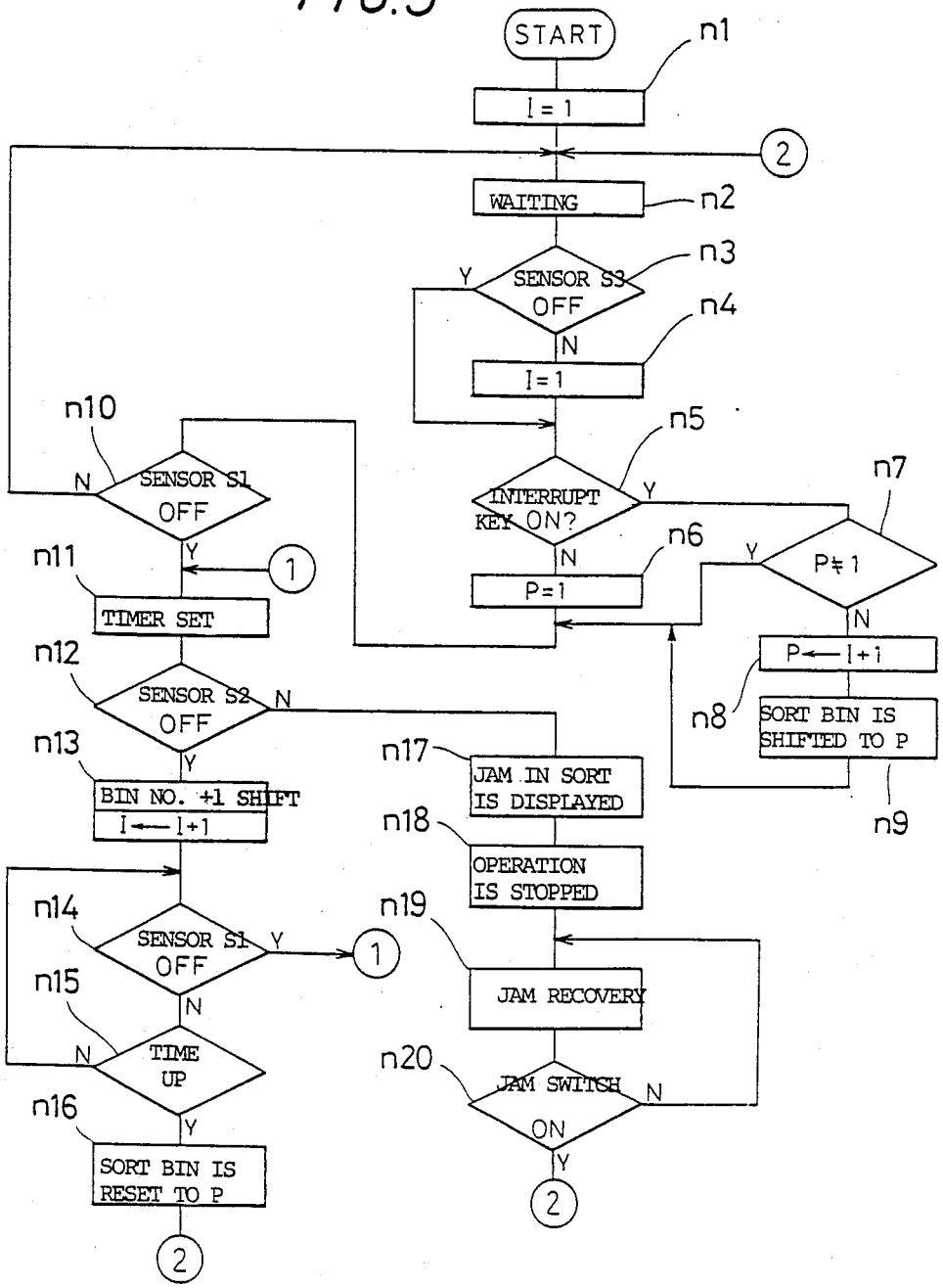
FIG. 3 is a flow chart of the operation of the copying machine according to the present invention.

FIG. 3 is a flow chart of the operation of the control means for controlling the guides G1 to Gn. After the power on, the steps are executed as follows:

Step n1: An initial value "1" is set into a last bin-number storing area I within the memory means of the copying machine. The last bin-number storing area I is the last bin-number memory means as called in the present specification.

Steps n2–n9: These steps are a waiting routine.

Step n2: The display condition of the operation panel is detected.

Step n3: The photosensor S3 scans the bin B1 to Bn to detect the presence of paper therein. If the photosensor is switched on, it can be assumed that the sorter is not being used so that no papers are sorted into the bins.

Step n4: The initial value "1" is set into the last bin-number memory I in view of the detection of step n3.

If the photosensor S3 is turned off, it is detected that the sorter has been used to sort at least one paper into a bin. All of the bins with their serial numbers less than or equal to the serial number stored in the last bin-number storing area I have been operated. Therefore, the value of the last bin-number storing area I is maintained by skipping step n4.

Step n5: It is detected whether the interruption switch 16 is operated or not.

Step n6: This step is selected to conduct the normal sort mode if the interruption switch 16 is not operated. In step n6, a value "1" is set into a sort starting bin-number area P within the memory means of the copying machine.

Step n7: This step is selected to detect the value of the sort bin-number area P if the interruption switch 16 is operated.

Step n8: If P has the value "1", a value of "I+1" is set into the sort starting bin-number area P as the bin-number for starting the interruption sort. The operation of step n8 enables that the papers copied in the interruption mode are sorted into the bins subsequent to the bins having the papers copied in the normal sort mode.

Step n9: The serial numbers of the bins subjected to the sort mode are shifted to the serial number of the bin with the bin serial number stored in the sort starting bin-number storing area P. The operations of steps n8 and n9 are executed by the interruption sort means of the present invention.

Step n10: This step is selected after step n6 or n9.

When it is detected in step n7 that the sort starting bin-number memory P has a value other than "1", meaning that the copying machine has been placed in the interruption sort mode, step n10 is selected by skipping steps n8 and n9. In step n10, if the photosensor S1 is turned off, the sort mode is recovered since it is assumed that the copying machine is exhausting a copied paper. If the photosensor S1 remains on, step n2 is reselected to repeat the waiting routine.

Step n11: This step is selected when, in step n10, the copied paper exhaustion is detected. In step n11, a timer is set. The time period set by the timer is set longer than the exhaustion interval of the papers in the continuous copying mode and shorter than the exhaustion interval of exhausting copied papers during a changing of the copying documents.

Step n12: It is detected whether the photosensor S2 is turned on or off. If the photosensor S2 is off, it can be assumed that the copied paper is being sorted and is being transported into the bin without any trouble, so that step n13 is selected. If the photosensor S2 is on, because it can be assumed that the paper exhausted from the copying machine is jammed within the sorter and, the jam recovery steps of step n17 and the subsequent steps are selected.

Step n13: For next sorting operation, the selection of the serial number of the bin to receive the next sorted paper is shifted by 1. The value of the last bin-number area I is therefore increased by "1".

Before the time period set in step n11 is counted down, the exhaustion of the next paper indicates a continuous copying of the same document, so that the detection of step n14 returns the operation to step n11 in order to repeat the same procedure.

Therefore, in the normal sort mode, a plurality of papers copied from the same document are subsequently sorted into the bins starting with the first bin in turn. In the interruption sort mode, the plurality of copied papers are sorted into the bins starting with the bin of the value of (I+1) in turn, I being the value of the last bin-number area I to receive a copied paper upon switching the interruption sort switch means. When the time period of the timer means has elapsed without detecting the exhaustion of any paper, it is assumed that time is consumed in order to replace the old document with a new one, so that the bin serial number for sorting is reset to be the value of the sort starting bin-number area P and step n2 is thereby reselected.

Step n17: This step is selected if the paper jam can be detected in step n12. The jam display 13 is illuminated.

Step n18: The copying operation is stopped.

Step n19: The jammed paper is removed from the copying machine.

Step n20: When the reset switch 15 is operated, step n2 is reselected by the detection of step n20.

The contents of the last bin-number memory area I are automatically cleared when all of the copied papers are removed from the bins of the sorter.

As described above, according to the present invention, while a plurality of sets of copy documents are being copied, additional documents may be copied in the middle of such a copying operation by operating the interruption switch is to enable the interruption sort copying. After the copying operation in the interruption sort mode, the interruption switch is turned off to recover the first sort mode. It may be evident that the additional documents to be copied should not be limited to being sorted and may be otherwise simply copied without any sorting operation.

When a plurality of different sets of copy documents are to be copied with sorting, after the first set of papers are copied and sorted, the interruption switch is actuated to copy the second set of copy documents and sort their copied papers. The copied papers of the second set of documents are sorted into the bins just subsequent to the bins having the copied papers of the first set of papers. Thus, the different sets of copied papers can be sorted into separate bins of the sorter. The different sets of documents can be continuously copied and sorted into the subsequent bins of the sorter.

While only certain embodiments of the present invention have been described, it will be apparent to those skilled in the art that various changes and modifications may be made therein without departing from the spirit and scope of the present invention as claimed.

What is claimed:

1. An electrophotographic copying machine comprising:

a plurality of sorter bins for receiving a plurality of copied papers in a sort mode;

a plurality of sorter guides for sequentially guiding each of the plurality of copied papers into each of said plurality of sorter bins;

sort switch means for interrupting the sort mode and conducting an additional sort mode;

memory means for storing the serial number of a last bin to receive a copied paper in the sort mode;

means for detecting the operation of said sort switch means each time a single one of said plurality of copied papers is received in a respective sorter bin; and interruption means, responsive to said means for detecting, for sorting one or more copied papers into one or more of said bins having the next higher serial number to said bin whose serial number is sorted in said memory means.

2. The machine of claim 1, wherein said memory means is automatically cleared when said plurality of copied papers are removed from said plurality of sorter bins.

3. The machine of claim 1, further comprising timer means for counting a time interval longer than is required for exhausting the copied papers from the copying machine in the continuous copying mode without changing the copying documents and shorter than the length of time required to manually change copying documents.

4. The machine of claim 1, further comprising memory means for sorting the serial number of a first bin to receive a copied paper in the sort interruption mode selected by said sort switch means.

* * * * *